US007267203B2

(12) United States Patent
Sekimoto

(10) Patent No.: US 7,267,203 B2
(45) Date of Patent: Sep. 11, 2007

(54) ELEVATOR INCLUDING OPERATION, ATMOSPHERIC PRESSURE AND RESCUE CONTROL

(75) Inventor: Yoichi Sekimoto, Fuchu (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 73 days.

(21) Appl. No.: 11/204,995

(22) Filed: Aug. 17, 2005

(65) Prior Publication Data

US 2006/0051189 A1 Mar. 9, 2006

Related U.S. Application Data

(63) Continuation of application No. PCT/JP2004/008564, filed on Jun. 11, 2004.

(51) Int. Cl.
*B66B 1/34* (2006.01)

(52) U.S. Cl. ..... 187/393; 454/68

(58) Field of Classification Search ..... 187/391, 187/393, 277, 213, 214, 313, 314, 390; 454/68, 454/238, 248
See application file for complete search history.

(56) References Cited

U.S. PATENT DOCUMENTS

| | | | | |
|---|---|---|---|---|
| 1,767,988 | A * | 6/1930 | Knapp | 454/68 |
| 4,592,270 | A * | 6/1986 | Vener | 454/68 |
| 5,080,003 | A * | 1/1992 | Kappeler | 454/68 |
| 5,354,233 | A * | 10/1994 | Mandy et al. | 454/68 |
| 5,593,347 | A * | 1/1997 | Mandy et al. | 454/68 |
| 7,059,958 | B2 * | 6/2006 | Santos | 454/68 |
| 2006/0175143 | A1 * | 8/2006 | Fujita et al. | 187/314 |

FOREIGN PATENT DOCUMENTS

| | | | |
|---|---|---|---|
| JP | 59-43780 | | 3/1984 |
| JP | 03138283 | A * | 6/1991 |
| JP | 9-100077 | | 4/1997 |
| JP | 10-87189 | | 4/1998 |
| JP | 2003-118943 | | 4/2003 |
| JP | 2004-10286 | | 1/2004 |

* cited by examiner

*Primary Examiner*—Jonathan Salata
(74) *Attorney, Agent, or Firm*—Oblon, Spivak, McClelland, Maier & Neustadt, P.C.

(57) ABSTRACT

In an elevator system having an elevator control unit and an atmospheric pressure control unit, an elevator operation state monitor monitors the operation state of the elevator control unit, and an atmospheric pressure control state monitor monitors the operation state of the atmospheric pressure control unit. When a trouble in the elevator operation or atmospheric pressure control is detected, a minor/major trouble judgment unit judges the seriousness level of the trouble, and a rescue mode selector selects a rescue mode. In this case, when the atmospheric pressure control is abnormal, it is judged a major trouble, and a mode to ensure ventilation in an elevator car is selected. This enhances the safety in a highly airtight elevator such as a superhigh-speed high-rise elevator.

10 Claims, 5 Drawing Sheets

ELEVATOR INCLUDING OPERATION, ATMOSPHERIC PRESSURE AND RESCUE CONTROL

CROSS-REFERENCE TO RELATED APPLICATIONS

This is a Continuation Application of PCT 5 Application No. PCT/JP2004/008564, filed Jun. 11, 2004, which was published under PCT Article 21(2) in Japanese.

BACKGROUND OF THE INVENTION

1. Field of the Invention

The present invention relates to an elevator system having an atmospheric pressure control unit to control the pressure in an elevator car during movement up and down.

2. Description of the Related Art

As elevators have been operated at superhigh speeds in high-rise buildings in recent years, a change in the atmospheric pressure in an elevator car during ascent and descent is not ignored. If the pressure in an elevator car is largely changed, it causes discomfort in the passengers' ears and impairs the riding comfort.

To lighten the influence of the pressure change in an elevator car, it has been considered to provide an atmospheric pressure control unit to keep the pressure in the car optimum during movement up and down. (For example, Published Japanese Patent No. 10-87189) The pressure control unit dissolves the discomfort caused by the pressure change, and passengers can use an elevator comfortably. Such a new technology is required in a future superhigh-speed elevator at a speed of 1000 m/min and an ascent/descent stroke of 400 m.

An elevator system is required to take an immediate and appropriate measure to ensure the safety of passengers when any abnormal condition occurs, for example, when a trouble occurs in an elevator car and the car fails to move normally, or an abnormal condition occurs in the elevator itself. A trouble in the above-mentioned pressure control unit is also included in such accidental cases. Particularly, a car of a superhigh-speed elevator is highly airtight, and if a trouble occurs in the air pressure unit serving also as a ventilator, it is important to ensure ventilation in the car.

In a conventional elevator system, safety measures are not established for troubles in a pressure control unit and the elevator itself.

BRIEF SUMMARY OF THE INVENTION

It is an object of the present invention is to provide an elevator system, which can ensure the safety of passengers in an elevator car by taking a prompt measure according to the operation states of an elevator and atmospheric pressure control unit, when a trouble occurs.

According to a first aspect of the invention, there is provided an elevator system having an elevator operation control unit to control the operation of an elevator, and an atmospheric pressure control unit to control the pressure in an elevator car by operating a blower installed in the car, comprising an elevator operation state monitoring means for monitoring the operation state of the elevator operation control unit, an atmospheric pressure control state monitoring means for monitoring the operation state of the atmospheric pressure control unit, and a rescue control means for executing a specific appropriate rescue process selected according to the seriousness level of a trouble when a trouble in an elevator is detected by the elevator operation state monitoring means or when an abnormal change in atmospheric pressure is detected by the atmospheric pressure control state monitoring means.

In this configuration, when a trouble occurs, the seriousness level of the trouble is determined by the elevator operation state and atmospheric pressure control state, and an appropriate rescue process is promptly executed according to the seriousness level of the trouble.

Namely, when a trouble in the atmospheric pressure control is detected, the state is judged a major trouble and a forced ventilation mode is executed to ensure forced ventilation in the elevator car.

When a trouble in the elevator operation is detected and the elevator can stop at the nearest floor or specific floor and the door of the elevator car is normal, the state is judged a minor trouble regardless of the atmospheric pressure control state, and a rescue mode is executed to let the passengers get off the elevator car at the nearest floor or a specific floor.

When a trouble in the elevator operation is detected and the elevator cannot stop at the nearest floor or a specific floor or the door of the elevator car is abnormal, the state is judged a minor trouble or a major trouble according to the atmospheric pressure control state. In this case, if the atmospheric pressure control is normal, the state is judged a minor trouble, and a ventilation control mode is executed to ensure ventilation in the elevator car by the atmospheric pressure control unit. If the atmospheric pressure control is abnormal, a forced ventilation mode is executed to ensure forced ventilation in the elevator car.

When a power failure occurs, the state is judged a major trouble regardless of the elevator operation state and atmospheric pressure control state, and a forced ventilation mode is executed to ensure forced ventilation in the elevator car.

In the forced ventilation mode, ventilation in the elevator car is ensured by setting the door of the car openable with a limit by manual operation or by forcibly operating a blower installed in the car.

DETAILED DESCRIPTION OF THE INVENTION

Embodiments of the present invention will be explained hereinafter with reference to the accompanying drawings.

Figure 1:
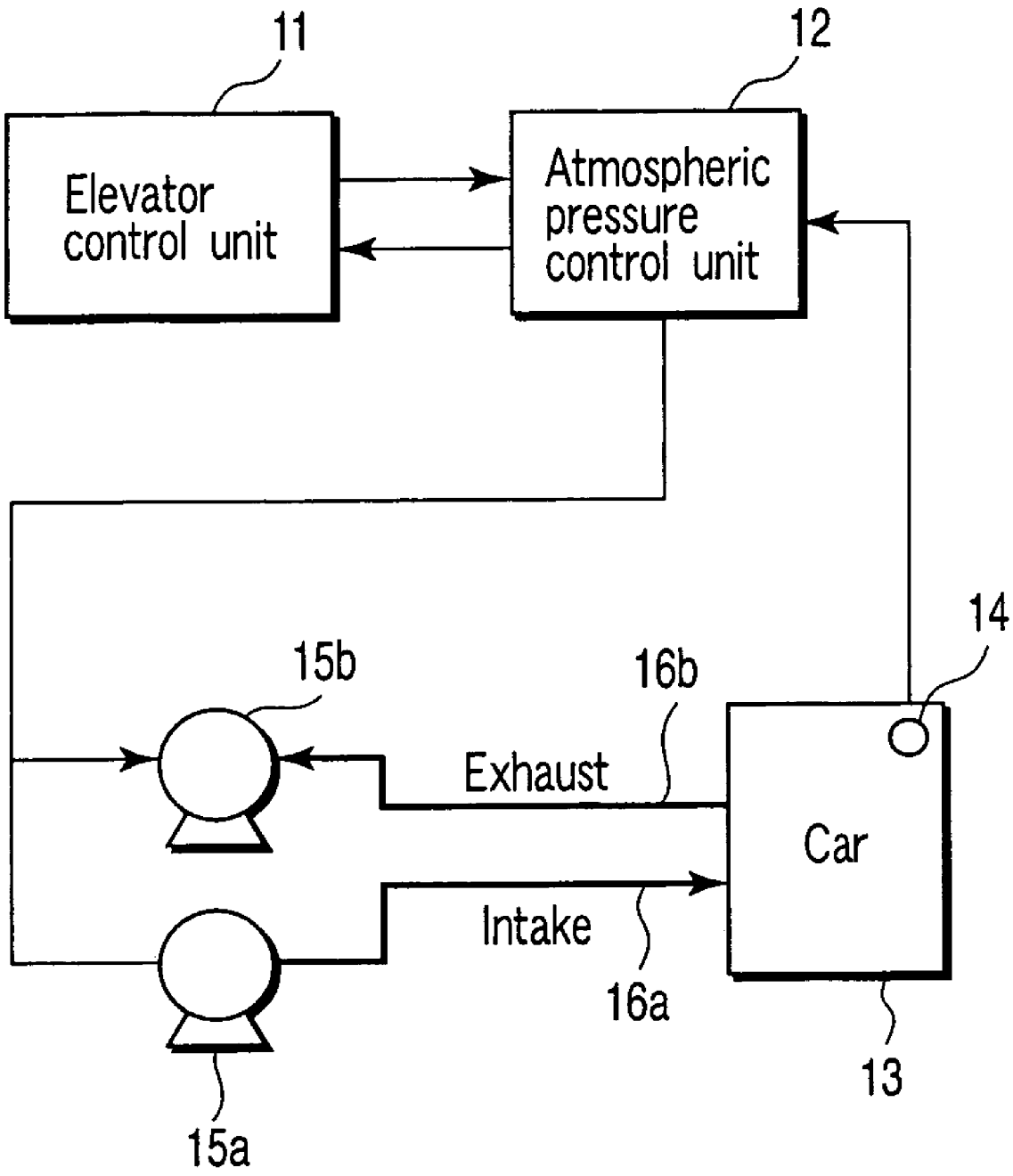
FIG. 1 is a block diagram showing the simplified configuration of an elevator system according to one embodiment of the present invention.

FIG. 1 is a block diagram showing the simplified configuration of an elevator system according to one embodiment of the present invention. The elevator system has the configuration with an atmospheric pressure system added to an ordinary elevator system. An ordinary elevator system is a system concerning the operation control of a whole elevator including group control. It is realized with an elevator operation control unit 11 installed in a machine room. This elevator system is well known, and detailed explanation will be omitted.

The atmospheric pressure system is a system to control the atmospheric pressure in an elevator car 13 when an elevator moves up and down. This atmospheric pressure system comprises an atmospheric pressure sensor 14 to detect the pressure in the car 13, an intake blower 15*a* to increase the atmospheric pressure in the car 13, an exhaust blower 15*b* to decrease the pressure in the car 13, duct piping 16*a* and 16*b* to connect the blowers 15*a* and 15*b* to the car 13, and an atmospheric pressure control unit 12 to drive and control these devices.

The atmospheric control unit 12 is installed in the car 13. The atmospheric control unit 12 performs inverter controlling of the rotation speeds of the intake blower 15*a* and exhaust blower 15*b* based on the atmospheric pressure detected by the atmospheric pressure sensor 14 and the position and speed of the car 13, in order to improve the riding comfort influenced by the pressure change in the car 13 when the elevator moves at a superhigh speed in high-rise floors. The atmospheric pressure control unit 12 can keep the pressure in the car optimum. At the same time, the atmospheric pressure control unit 12 adjusts ventilation in the car 13 by rotating the intake blower 15*a* and exhaust blower 15*b*.

The elevator operation control unit 11 and atmospheric pressure control unit 12 are realized by a computer that is controlled by respective programs.

Figure 2:
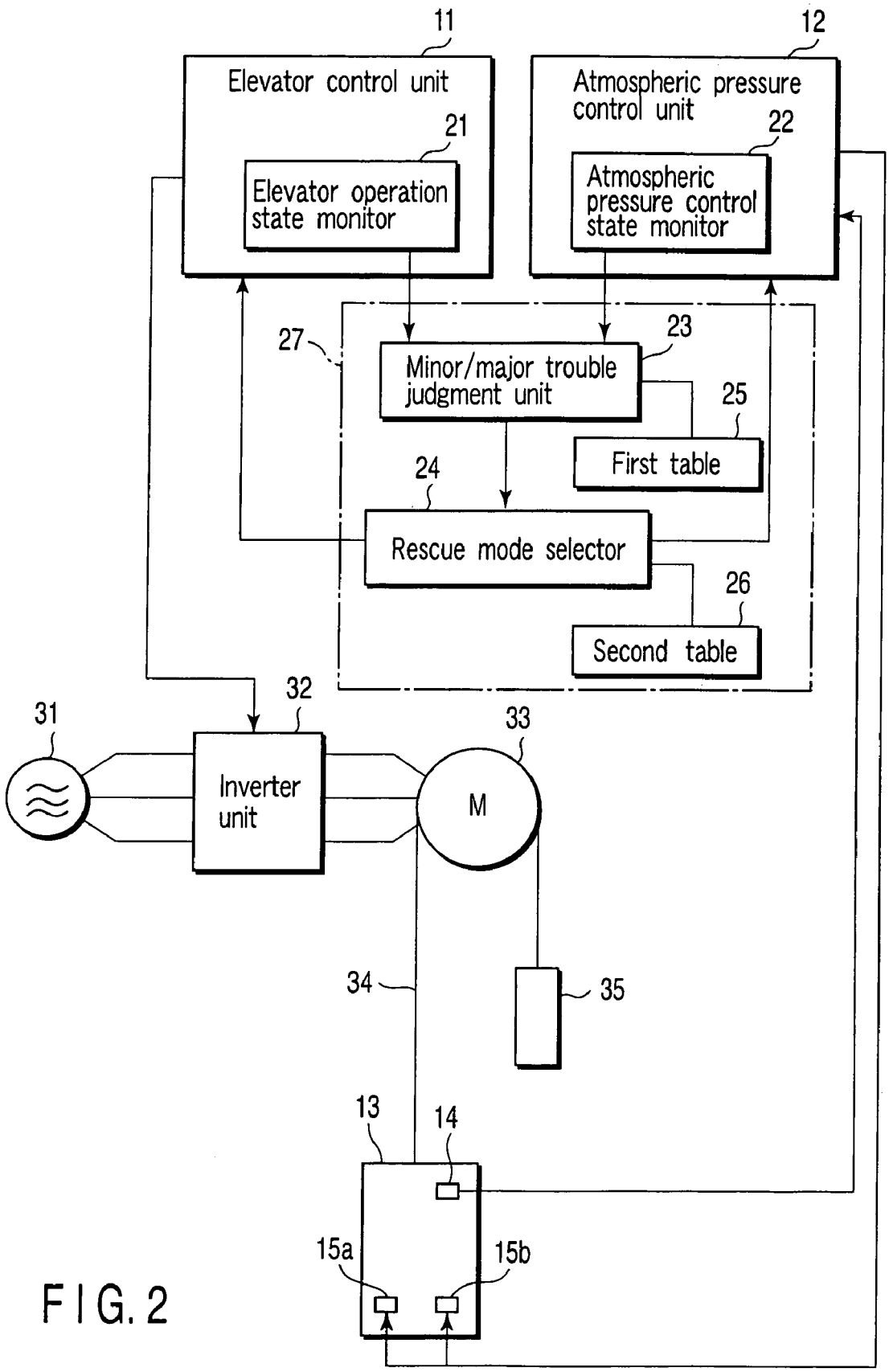
FIG. 2 is a block diagram showing the functional configuration of the elevator system.

FIG. 2 is a block diagram showing the functional configuration of the elevator system.

The elevator system of the present invention has the above-mentioned elevator operation control unit 11 and atmospheric pressure control unit 12. In addition, the elevator system is composed of an elevator operation state monitor 21, an atmospheric pressure control state monitor 22, a minor/major trouble judgment unit 23, a rescuer mode selector 24, a first table 25, and a second table 26.

The elevator operation control unit 11 controls the elevator operation. The elevator operation control unit 11 has the elevator operation state monitor 21 to monitor the elevator operation state (normal/abnormal). The atmospheric pressure control unit 12 controls the pressure in the car 13, synchronizing with the moving up/down of the elevator (car 13). The atmospheric pressure control unit 12 has the following control modes.

Figure 5:
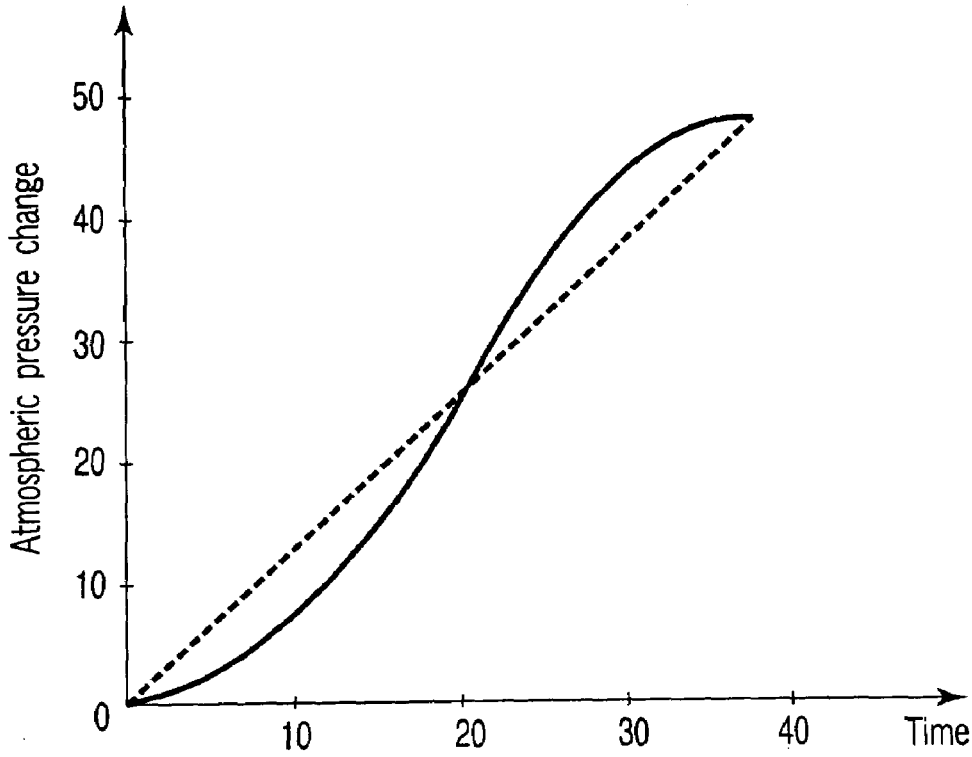
FIG. 5 is a graph showing the relationship between atmospheric pressure change and time for explaining atmospheric pressure control operation.

Pressure control mode: Controls to keep the pressure in the car 13 optimum as indicated by the dotted straight line in FIG. 5, with respect to a pressure change (indicated by the solid curve) during moving at a superhigh speed in a high-rise building, as shown by the solid curve.

Figure 6:
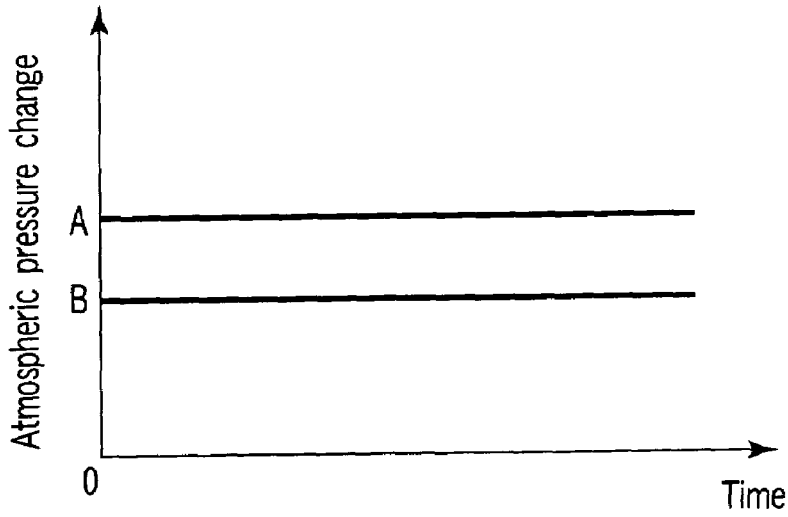
FIG. 6 is a graph showing the relationship between atmospheric pressure change and time for explaining ventilation control operation.

Ventilation control mode: Ventilates the car 13 not by the air pressure control, but by circulating the air in the car by the intake/exhaust operation with a certain volume of air (the intake-exhaust operation with a certain volume of air A/B as shown in FIG. 6), according to the operating conditions or when a trouble occurs.

Like the elevator operation control unit 11, the atmospheric pressure control unit 12 is also provided with an atmospheric pressure control state monitor 22 to monitor the pressure control state (normal/abnormal).

The minor/major trouble judgment unit 23, rescue mode selector 24, first table 25 and second table 26 constitute a rescue controller 27. When a trouble in the elevator operation is detected or an abnormal condition in the atmospheric pressure control is detected, the rescue controller 27 selects and executes a specific rescue process according to the seriousness level of the trouble.

The minor/major trouble judgment unit 23 obtains the elevator operation state and pressure control state from the elevator operation state monitor 21 and atmospheric pressure control state monitor 22, respectively, and when a trouble in at least one of the elevator operation and atmospheric pressure control is detected, judges the seriousness level of the trouble by referring to the fist table 25. In this embodiment, the seriousness level of trouble is classified into two levels, minor trouble and major trouble. The first table 25 includes the previously listed various conditions for judgment of minor or major trouble according to the elevator operation state and pressure control state when a trouble occurs.

When the minor/major trouble judgment unit 23 judges a trouble minor or major, the rescue mode selector 24 selects a rescue mode to ensure the safety of passengers in the car 13, according to the judgment results. As a rescue mode, there is an elevator rescue operation mode to move the elevator (elevator car 13) to the nearest floor or specific floor (specified as a refuge floor) if possible even if the elevator speed is low. Another rescue mode is a ventilation control mode to ensure ventilation in the car 13 by operating the intake blower 15*a* or exhaust blower 15*b* if the elevator cannot move. The other rescue mode is a forced ventilation mode to ensure ventilation forcibly by opening the door by manual operation if the ventilation control is impossible. The second table 26 includes the data for selection of a suitable rescue mode according to the situations, together with the previously listed various conditions.

The rescue controller 27, comprising the minor/major trouble judgment unit 23, rescue mode selector 24, first table 25 and second table 26, is realized by software, and is provided as a function of the elevator operation control unit 11, for example.

In FIG. 2, a reference numeral 31 denotes a power supply, 32 denotes an inverter, and 33 denotes a hoist. They are installed in a machine room together with the elevator operation control unit 11. The power supply 31 is an elevator driving source. The inverter 32 is operated from the power supply 31, and drives the hoist 33 according to an instruction from the elevator operation control unit 11. A main rope 34 is wound around a jib provided in the rotary shaft of the hoist 33. The elevator car 13 and counter weight 35 equivalent to the weight of the car are fixed to both ends of the main rope 34. When the hoist 33 is driven and the jib is rotated, the car 13 and counter weight 35 moves up and down in a shaft just like a well bucket.

The car 13 is provided with the atmospheric sensor 14, intake blower 15*a* and exhaust blower 15*b*. The atmospheric pressure detected by the atmospheric pressure sensor 14 is inputted to the atmospheric pressure control unit 12. The intake blower 15*a* and exhaust blower 15*b* are driven by a driving signal outputted from the atmospheric pressure control unit 12. Air is taken in the car 13 by the intake blower 15*a*, and exhausted by the exhaust blower 15*b*.

Next, the operation of this system will be explained.

The operation of this system is divided into (a) basic operation, (b) operation on power failure, and (c) operation on trouble.

(a) Basic Operation

The elevator operation state monitor 21 monitors the elevator operation state (normal/abnormal). When a trouble in the elevator operation is detected, (c) operation on trouble takes place.

The atmospheric pressure control state monitor 22 monitors the atmospheric pressure control state (normal/abnormal). When a trouble in the atmospheric control state is detected, (c) operation on trouble takes place.

A power failure is monitored. The elevator operation control unit 11 checks for a power failure. When a power failure occurs, (b) operation on power failure takes place.

(b) Operation on Power Failure

When a power failure occurs, both elevator operation and atmospheric pressure control fail. Wait until power is restored and the elevator is restarted. Otherwise, a maintenance staff rushes to the car 13 and rescues the passengers in the car. This case is a major trouble. Ensure ventilation in the car 13 by the following methods.

When a trouble occurs in the atmospheric pressure control unit 12, including a power failure, it is impossible to ventilate the car 13 by operating the intake blower 15*a* and exhaust blower 15*b* under the control of the atmospheric pressure control unit 12. Thus, for example, set the door of the car 13 openable with a limit by manual operation, or by operating forcibly the intake blower 15*a* and exhaust blower 15*b* installed in the car 13, thereby ensuring forced ventilation in the car 13. This is called a forced ventilation mode.

(c) Operation on Trouble

When a trouble occurs and the elevator cannot stop the nearest floor or specific floor (specified as a refuge floor) or the elevator can stop the floor but the door of the car 13 does not open, check the atmospheric pressure control state. If the atmospheric pressure control is abnormal, judge the state a major trouble, ventilate the car 13 by force, and wait for a rescue.

If the atmospheric control is normal in the above state, the car 13 can be ventilated, and the safety of passengers can be ensured though the passengers are not promptly rescued. Judge the state a minor trouble, ventilate the car 13 by operating the intake blower 15*a* and exhaust blower 15*b* under the control of the atmospheric pressure control unit 12, and wait for a rescue. This is called a ventilation control mode.

When a trouble occurs, but the elevator can stop the nearest floor or specific floor, and the door is normal (that is, the elevator rescue operation is possible), judge the state a minor trouble regardless of the atmospheric pressure control state, stop the elevator at the nearest floor or specific floor, and open the door and let the passengers get off the car 13. This is called an elevator rescue operation mode.

When the elevator operation is normal, but the atmospheric pressure control is abnormal, the elevator can stop the nearest floor or specific floor and the door can be opened. Judge the state a minor trouble, and rescue the passengers from the car 13 according to the elevator rescue operation mode.

Figure 3:
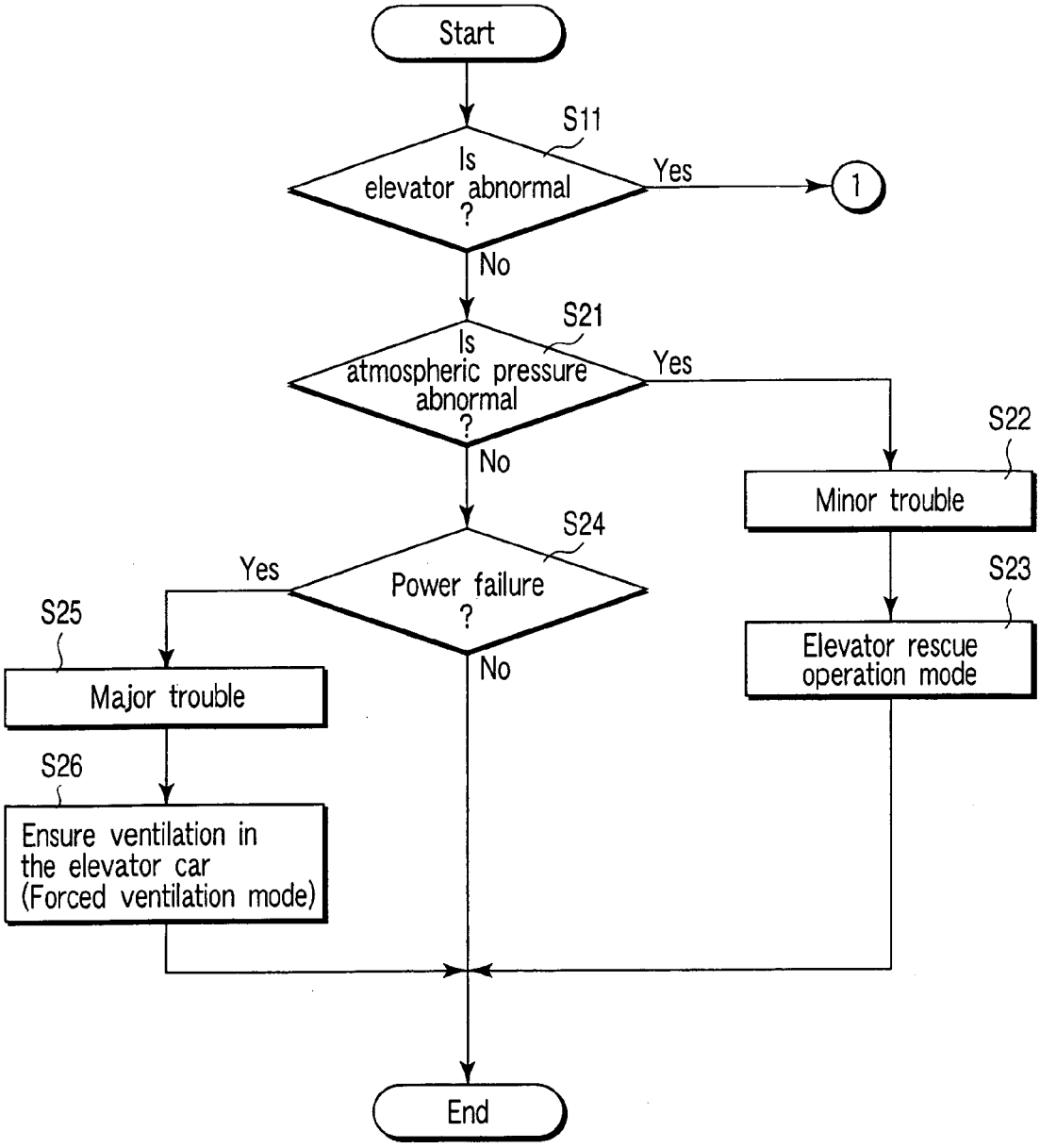
FIG. 3 is a flowchart for explaining the operation of the elevator system.
Figure 4:
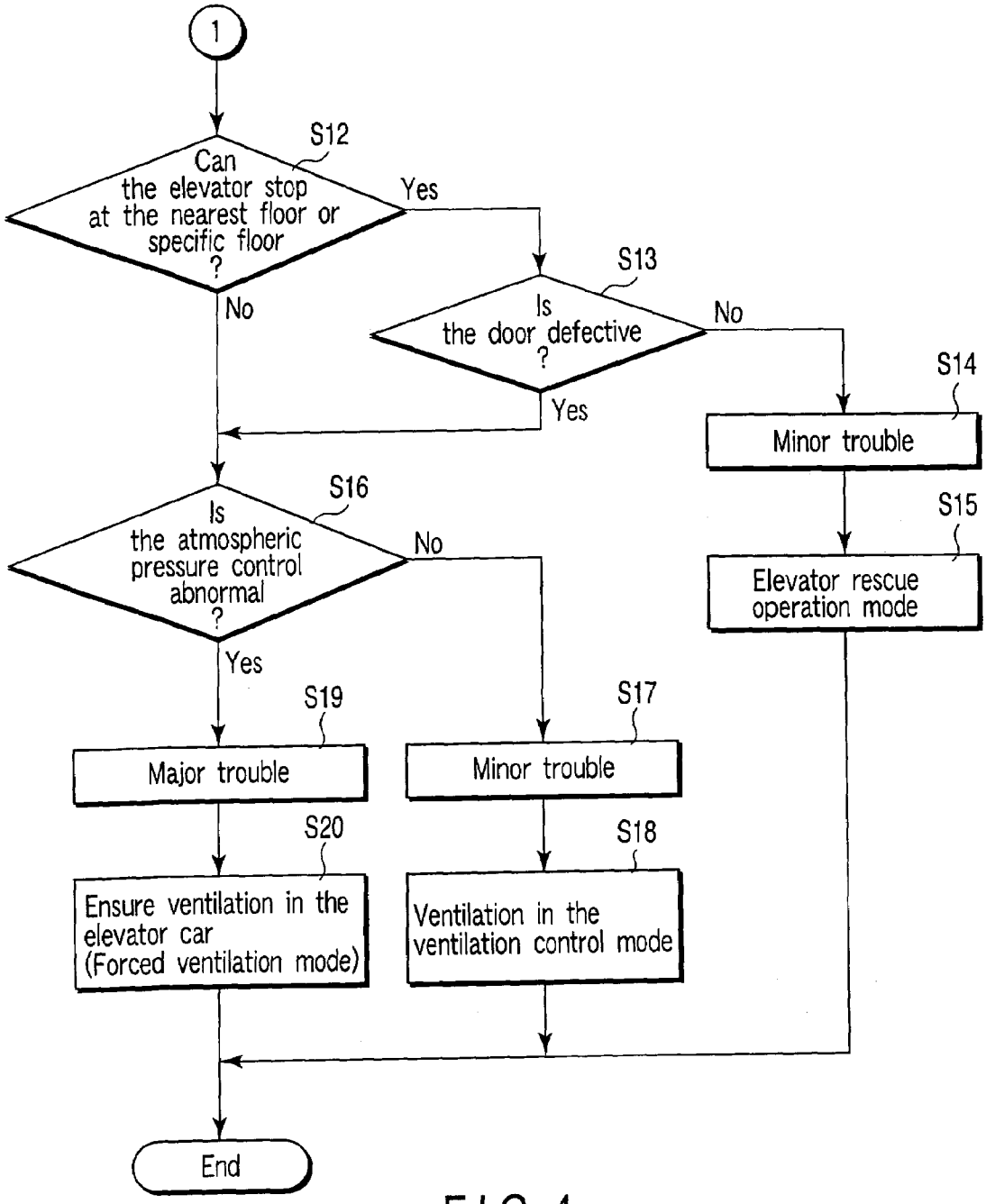
FIG. 4 is a flowchart for explaining the operation of the elevator system.

Now, the operation of the above-mentioned system will be explained in detail with reference to the flowcharts of FIG. 3 and FIG. 4.

Assume that the elevator is normally operated under the control of the elevator operation control unit 11. In this time, as the elevator (car 13) moves up and down, the atmospheric pressure in the car 13 is kept at an optimum value by the control of the atmospheric pressure control unit 12, thereby preventing uneasiness caused by a pressure change during moving up/down, and ensuring ventilation in the car 13.

When a trouble in the elevator is detected by the elevator operation state monitor 21 (Yes in step S11), the sate is sent to the minor/major trouble judgment unit 23. A trouble in the elevator means that the elevator cannot perform normal operations (moving to an object floor at a rated speed in response to a call from a platform or a car).

The minor/major trouble judgment unit 23 judges a trouble minor or major according to the states of the elevator and atmospheric pressure control, when a trouble occurs. If the elevator can stop the nearest floor or specific floor (refuge floor) (Yes in step S12) and the door of the car 13 is not defective (No in step S13), the minor/major trouble judgment unit 23 searches the first table 25 by these conditions, judges the state a minor trouble, and informs the rescue mode selector 24 of the state (step S14).

The rescue mode selector 24 selects a rescue mode suitable for the situation based on the judgment of the minor/major trouble judgment unit 23. In this case, the rescue mode selector 24 searches the second table 26 by the condition of elevator abnormal+major trouble, and selects a specific operation mode called an elevator rescue operation mode (step S15). The elevator (car 13) is moved to the nearest floor or a specific floor, the door is opened, and the passengers can be rescued from the car 13.

When a trouble in the elevator is detected and the elevator cannot stop the nearest floor or specific floor (No in step 12), or the elevator can stop that floor, but the door of the car 13 is defective (Yes in step S13), the minor/major trouble judgment unit 23 judges it a minor trouble or a major trouble based on the atmospheric pressure control state monitored by the atmospheric control state monitor 22. In this case, if the atmospheric pressure control is abnormal (No in step 16), the minor/major trouble judgment unit 23 searches the first table 25 by these conditions, and judges the state a minor trouble, and informs the rescue mode selector 24 of the state (step S17).

In this case, the rescue mode selector 24 searches the second table 26 by the condition of elevator abnormal+pressure control normal+minor trouble, and selects the ventilation control mode (step S18). In the ventilation control mode, at least one of the intake blower 15*a* and exhaust blower 15*b* installed in the car 13 is operated under the control of the atmospheric pressure control unit 12, and the ventilation in the car 13 is ensured.

If the atmospheric pressure control is also abnormal in addition to the elevator trouble (Yes in step S16), the minor/major trouble judgment unit 23 judges it a major trouble, and informs the rescue mode selector 24 of the state (step S19), The abnormal atmospheric pressure control means the state that the intake blower 15*a* and exhaust blower 15*b* installed in the car 13 cannot be normally operated. In such a case, it is necessary to ensure ventilation in the car 13 by any means.

In this case, the rescue mode selector 24 searches the second table by the condition of elevator abnormal+pressure control abnormal+major trouble, and selects the forced ventilation mode (step S20). Concretely, ventilation in the cage 13 is forcibly ensured by setting the door of the car 13 openable by the manual operation, or operating forcibly the intake blower 15*a* and exhaust blower 15*b* in the car 13 by battery power. In this forced ventilation mode, the forced ventilation in the car 13 is ensured and the safety of passengers can be ensured until a maintenance staff rushes to the spot.

In the forced ventilation mode, if the door is set openable by the manual operation, there is the danger that a passenger opens the door fully. It is thus preferable to give a limit to the manual opening of the door, so that the door can be opened only by several centimeters to ensure ventilation. Further, when the door is opened, a warning message "Open the door carefully" may be announced or displayed on a screen. A small window dedicated for emergency ventilation may be provided in the car, and announce or display a message "Open the window for ventilation" to prompt the passengers in the car 13 to ventilate the car.

If the elevator is normal (No in step S11), but the atmospheric pressure control is abnormal (Yes in step S12), the minor/major trouble judgment unit 23 refers to the first table 25, judges the state a minor trouble, and informs the rescue mode selector 24 of the state. The rescue mode selector 24 refers to the second table 26, selects the elevator rescue mode, moves the elevator (car 13) to the nearest floor or specific floor, and rescues the passengers from the car 13.

When a power failure occurs (Yes in step S24), neither the elevator operation control nor atmospheric pressure control work, the minor/major trouble judgment unit 23 judges the state a major trouble, and informs the rescue mode selector 24 of the state. The rescue mode selector 24 selects the forced ventilation mode upon a power failure, and operates forcibly the intake blower 15*a* and exhaust blower 15*b* in the car 13 with batteries. Thereby, the car 13 is forcibly ventilated and the safety of passengers can be ensured, until maintenance staff rush to the spot.

The elevator operation state and atmospheric pressure control state are monitored as described above. When a trouble occurs, a rescue mode suitable for the situation is selected, and the safety of the passengers in the car can be ensured. Particularly, when the atmospheric pressure control goes abnormal, a top priority is given to ventilation in the car. This enhances the safety in a highly airtight elevator such as a superhigh-speed high-rise elevator.

In the above embodiment, when a trouble occurs in the elevator or atmospheric pressure control, the trouble is judged minor or major according to the situation. The seriousness of trouble may be judged in levels 1 to 5, and a rescue mode may be selected to meet each level. This can be realized by setting the conditions and rescue processes for each level in the first table 25 and second table 26.

In short, the present invention is not limited to the aforementioned embodiment. The invention may be embodied in other specific forms without departing from its sprit or essential characteristics.

As explained hereinbefore, according to the present invention, in an elevator system provided with an atmospheric pressure control unit, when a trouble occurs, the seriousness level of the trouble is judged not only by the elevator operation state but also the atmospheric pressure control state, and a rescue process suitable for the seriousness level of the trouble is executed. Thus, the safety of passengers in an elevator car can be ensured. Particularly, when the atmospheric pressure control goes abnormal, a top priority is given to ventilation in the car. This enhances the safety in a highly airtight elevator such as a superhigh-speed high-rise elevator.

What is claimed is:

1. An elevator system having an elevator operation control unit to control the operation of an elevator, and an atmospheric pressure control unit to control the pressure in an elevator car by operating a blower installed in the car, comprising:

an elevator operation state monitoring means for monitoring the operation state of the elevator operation control unit;

an atmospheric pressure control state monitoring means for monitoring the operation state of the atmospheric pressure control unit; and a rescue control means for executing a specific rescue process selected according to the seriousness level of a trouble when a trouble in an elevator is detected by the elevator operation state monitoring means or when an abnormal change in atmospheric pressure is detected by the atmospheric pressure control state monitoring means.

2. The elevator system according to claim 1, wherein when a trouble in the atmospheric pressure control is detected, the rescue control means judges the state a major trouble, and executes a forced ventilation mode to ensure forced ventilation in the elevator car.

3. The elevator system according to claim 1, wherein when a trouble in the elevator operation is detected and the elevator can stop at the nearest floor or specific floor and the door of the elevator car is normal, the rescue control means judges the state a minor trouble regardless of the atmospheric pressure control state, and executes a rescue mode to let the passengers get off the elevator car at the nearest floor or specific floor.

4. The elevator system according to claim 1, wherein when a trouble in the elevator operation is detected and the elevator cannot stop at the nearest floor or specific floor or the door of the elevator car is abnormal, the rescue control means judges the state a minor trouble or a major trouble according to the atmospheric pressure control state.

5. The elevator system according to claim 4, wherein when the atmospheric pressure control is normal, the rescue control means judges the state a minor trouble, and executes a ventilation control mode to ensure ventilation in the elevator car by the atmospheric pressure control unit.

6. The elevator system according to claim 4, wherein when the atmospheric pressure control is abnormal, the rescue control means judges the state a major trouble, and executes a forced ventilation mode to ensure forced ventilation in the elevator car.

7. The elevator system according to claim 1, wherein when a power failure occurs, the rescue control means judges the state a major trouble regardless of the elevator operation state and atmospheric pressure control state, and executes a forced ventilation mode to ensure forced ventilation in the elevator car.

8. The elevator system according to any one of claims 2, 6 and 7, wherein in the forced ventilation mode, the door of the car is set openable with a limit by manual operation.

9. The elevator system according to any one of claims 2, 6 and 7, wherein in the forced ventilation mode, a blower installed in the elevator car is forcibly operated.

10. An elevator system having an elevator operation control unit to control the operation of an elevator, and an atmospheric pressure control unit to control the pressure in an elevator car by operating a blower installed in the car, comprising:

an elevator operation state monitor which monitors the operation state of the elevator operation control unit;

an atmospheric pressure control state monitor which monitors the operation state of the atmospheric pressure control unit; and a rescue controller which executes a specific rescue process selected according to the seriousness level of a trouble when a trouble in an elevator is detected by the elevator operation state monitor or when an abnormal change in atmospheric pressure is detected by the atmospheric pressure control state monitor.

* * * * *